US010421077B2

(12) United States Patent
Ratto et al.

(10) Patent No.: US 10,421,077 B2
(45) Date of Patent: Sep. 24, 2019

(54) LARGE CAPACITY UPRIGHT TILTING WET STONE GRINDER

(71) Applicant: Rottar Chocolate Machines, LLC, Raleigh, NC (US)

(72) Inventors: Samuel Anthony Ratto, Raleigh, NC (US); Roger E. Johnson, Greensboro, NC (US)

(73) Assignee: Rottar Chocolate Machines, LLC, Raleigh, NC (US)

( * ) Notice: Subject to any disclaimer, the term of this patent is extended or adjusted under 35 U.S.C. 154(b) by 316 days.

(21) Appl. No.: 15/477,756

(22) Filed: Apr. 3, 2017

(65) Prior Publication Data

US 2018/0280986 A1 Oct. 4, 2018

(51) Int. Cl.

| | |
|---|---|
| ***B02C 15/04*** | (2006.01) |
| ***B02C 17/18*** | (2006.01) |
| ***B02C 23/36*** | (2006.01) |
| ***B02C 17/16*** | (2006.01) |
| ***B02C 15/00*** | (2006.01) |

(52) U.S. Cl.

CPC ..... *B02C 15/04* (2013.01); *B02C 15/00* (2013.01); *B02C 15/004* (2013.01); *B02C 15/007* (2013.01); *B02C 17/163* (2013.01); *B02C 17/1825* (2013.01); *B02C 23/36* (2013.01)

(58) Field of Classification Search

CPC ..... B02C 15/04; B02C 15/007; B02C 15/004; B02C 15/00; B02C 17/1825; B02C 17/163; B02C 17/00; B02C 23/36; A47J 43/04

See application file for complete search history.

(56) References Cited

U.S. PATENT DOCUMENTS

| | | | | | |
|---|---|---|---|---|---|
| 2,564,096 | A * | 8/1951 | Clay | B02C 15/08 | 241/124 |
| 2,626,758 | A * | 1/1953 | Scarlett | B02C 15/14 | 241/124 |
| 2,676,760 | A * | 4/1954 | Simpson | B01F 7/307 | 241/127 |
| 3,093,326 | A * | 6/1963 | Zurell | B02C 18/0084 | 241/46.017 |
| 3,229,920 | A * | 1/1966 | Berner | B02C 21/00 | 241/158 |
| 3,408,774 | A * | 11/1968 | Anthony | B24B 31/06 | 241/171 |
| 3,519,052 | A * | 7/1970 | Girgis | B02B 1/04 | 241/246 |
| 3,700,176 | A * | 10/1972 | Haber | B01F 7/162 | 241/199.7 |
| 3,739,531 | A | 6/1973 | Sharbaugh | | |

(Continued)

FOREIGN PATENT DOCUMENTS

WO 2015056275 A1 4/2015

OTHER PUBLICATIONS

European Search Report from Corresponding Application No. 18165538.2.

(Continued)

*Primary Examiner* — Faye Francis

(74) *Attorney, Agent, or Firm* — James G. Passé; Passé Intellectual Property, LLC

(57) ABSTRACT

The present invention relates to tilting a wet stone grinder of capacity in the 125-300 liter size. Tilting is accomplished by a gear driven, manual or motorized tilting mechanism.

8 Claims, 5 Drawing Sheets

(56) References Cited

U.S. PATENT DOCUMENTS 4,367,855 A * 1/1983 von der Heide .... A01F 25/2036 241/101.76
4,373,674 A * 2/1983 Barrera ..... B02C 19/08 241/15
4,505,072 A * 3/1985 Kobayashi ..... B24B 31/0218 241/171
4,515,483 A * 5/1985 Muller ..... F26B 11/14 366/303
4,552,461 A * 11/1985 Ott ..... B01F 7/0025 366/194
4,863,278 A * 9/1989 Otto ..... A47J 43/046 366/143
5,217,688 A * 6/1993 Von Lersner ..... A61L 2/24 241/23
5,300,438 A * 4/1994 Augspurger ..... C05F 17/0205 366/220
5,992,775 A * 11/1999 Wingler ..... B02C 7/11 241/261.2
6,149,296 A * 11/2000 Asai ..... B01F 7/00208 366/313
7,584,911 B2 * 9/2009 Michalek ..... A61L 11/00 241/23
8,561,929 B2 * 10/2013 Davis ..... B02C 21/026 241/101.741
2014/0134305 A1 5/2014 Wolfe
2016/0151874 A1 6/2016 Jensen

OTHER PUBLICATIONS

"Commercial Tilting Wet Grinders." Chennai Imports, Inc., https://www.chennaiimports.com/Commercial%20Wet%20Grinders.htm. Accessed Mar. 31, 2017.
"Wet Grinder (Food)." Wikipedia, Oct. 20, 2016, https://en.wikipedia.org/wiki/Wet_grinder_(food). Accessed Oct. 21, 2016.

* cited by examiner

LARGE CAPACITY UPRIGHT TILTING WET STONE GRINDER

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to an upright wet stone grinder. In particular, it relates to a tilting wet stone grinder handling large capacities from about 125 liters to about 300 liters.

Description of Related Art

The use of commercial motorized wet grinding for food, especially grains and nuts, goes back to its beginnings around 1955 in India. Wet grinders for food consist of granite stones, which rotate inside a metal drum by utilizing an electric motor, where currently foods, such as grains, seeds, nuts, cocoa, and the like, are crushed to a paste. Use of these types of machines takes less heat than other types of grinding and the stones remain useful for a greater time than other crushing means, such as blades. Currently, the capacities for these wet grinders run up to about 45 liters, with the larger capacity vessels having manual tilting devices. The manual upright tilting grinder was introduced in 1975, again in India. The smaller wet grinders use belt driven motors, requiring safety cabinets around the motor to prevent injury and damage to the belt system upon tilting. The cabinets for these smaller wet grinder's motors are generally bigger than the vessel for the grinder. Tilting is accomplished by leverage by use of a welded arm on a frame of the grinder. The method of tilting has limited the size of these devices, due to shifting contents and varying contents. Very large capacity vessel grinders, which operate on the side of the vessel rather than upright, are available, but they usually start at around 500 liters or more to be practical for use.

The use of upright wet grinders for seeds and grains is still very popular in India and other Asian countries, but little interest has been shown outside of those countries until the cocoa bean to bar chocolate trade started. These manufacturers are too small for high capacity side grinders and, generally, while the 40 liter and below grinders work, they are too small for any kind of real use, with a storefront requiring several of these smaller machines constantly in use. In addition, cocoa nib grinding can take a day or more, requiring heavy duty motors that grinder models designed for seeds and the like just don't currently have.

BRIEF SUMMARY OF THE INVENTION

The present invention relates to the discovery of a tilting upright wet food grinding system that is about 125 liters to about 300 liters in capacity. A number of improvements in the wet grinder has allowed for a larger size upright wet grinder to be manufactured, as shown herein.

Accordingly, in one embodiment, there is a food preparation upright wet grinder comprising:

a) a cylindrical vessel having an inside bottom and outside wall, and a volume from about 125 liters to about 300 liters;
b) a center axle attached to and positioned vertically in the center of the vessel;
c) an adjustable speed gear driven motor positioned beneath the vessel, connected to rotate the center axle;
d) granite grinding stones positioned on opposite sides of the center axle for grinding against the vessel's inside bottom, wherein the stones are rotated against the inside bottom of the vessel by the rotating action of the vessel;
e) one or more scrapers for scraping an inside wall of the vessel, the scrapers having adjustable height and length arms, the blade being adjustable relative to the inside wall;
f) a tilt frame connected to the top of the center axle and the gear drive motor, comprising a pair of balance arms on opposite sides of the frame;
g) a base frame connected to the tilt frame by the balance arms; and
h) a gear drive for tilting the vessel on the balance arms to and from an upright position.

DETAILED DESCRIPTION OF THE INVENTION

Figure 1:
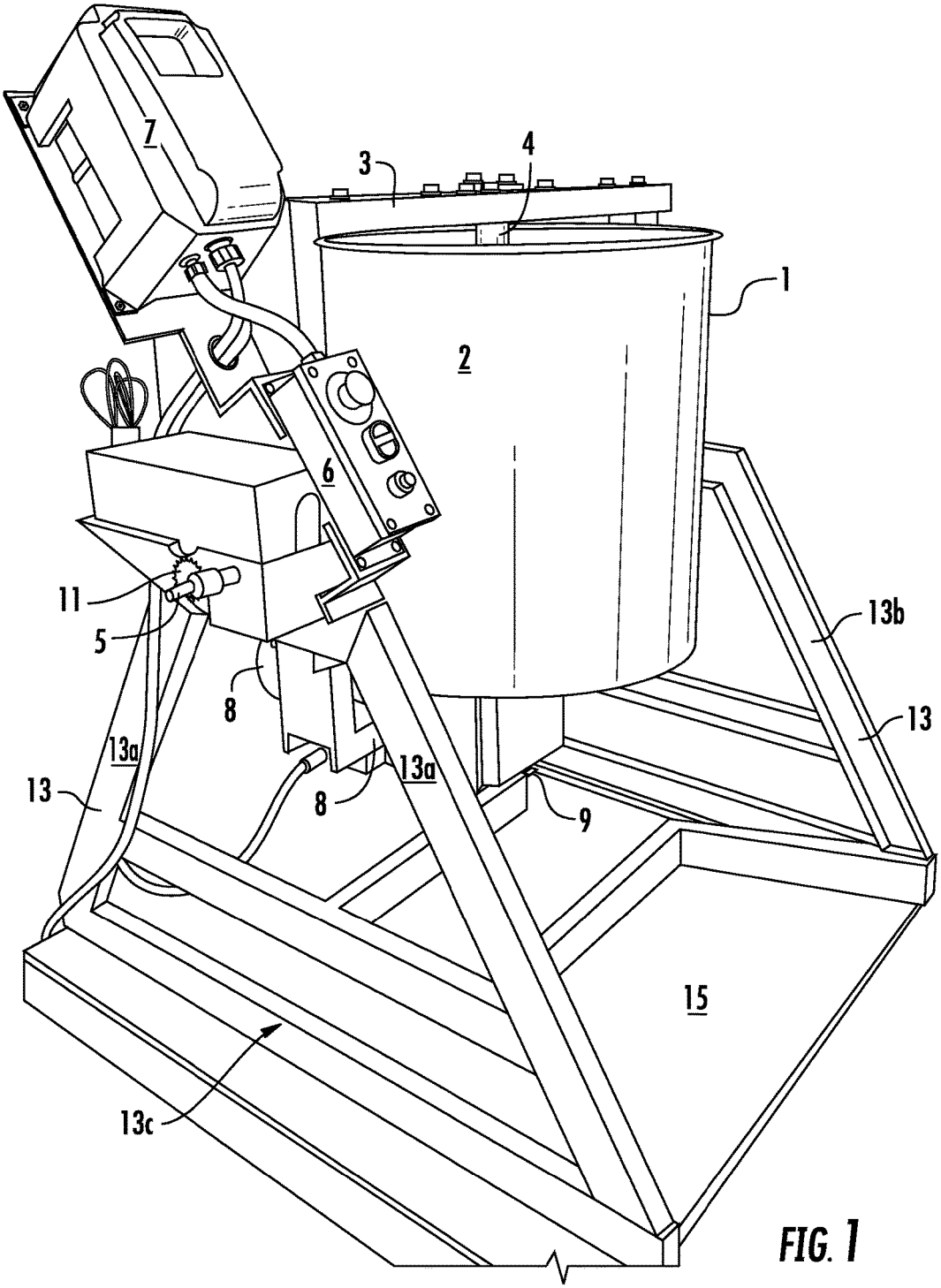
FIG. 1 is a perspective view of the current invention.

While this invention is susceptible to embodiment in many different forms, there is shown in the drawings, and will herein be described in detail, specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

References throughout this document to "one embodiment", "certain embodiments", and "an embodiment" or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitations thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "food preparation upright wet grinder" refers to a food preparation appliance used in grinding food grains, nibs, or other food particles to a smooth paste or the like. It consists of granite stones, which rotate inside of an upright metal vessel (i.e. a drum) with the help of an electric motor, wherein the food gets crushed between the stone and the inside bottom of the vessel. In the present invention the vessel is rotated and the stones turn via friction against the bottom of the vessel.

As used herein, the term "cylindrical vessel" refers to an open top metal drum or stock pot type shape. In one embodiment, it has a rolled edge. In the present invention the vessel is made of stainless steel, as are most of the parts which contact food (e.g. the wheels are granite), so that those parts can be sterilized between uses. The present invention is designed for vessels between about 125 liters and about 300 liters. In one specific embodiment, it is about 200 liters. The vessel has an open top, inside bottom, outside bottom, and a circular outside wall. Circular walls aid in the scraping, and even grinding, of the wet grinder. The bottom of the vessel has an opening for receipt of the center axle. In one embodiment, the vessel is about 26 inches in diameter and 24 inches high.

As used herein, the term "center axle" refers to a metal rod which acts to rotate the vessel circumferentially around the axle, which is positioned vertically in the center of the vessel. The center axle passes through the opening in the bottom of the vessel, is attached to the bottom of the vessel, and has gear teeth which mesh with the gear teeth of the gear motor positioned beneath the vessel which rotates the metal rod, i.e. at the top of the vessel the top of the axle rod is rotatably connected to the tilt frame, as shown in the drawings, in order to keep the axle aligned and rotating smoothly.

As used herein, the term "adjustable speed gear driven motor" refers to a particular type of motor. In general, motors are either belt driven, direct drive, or, in the case of the present invention, a gear motor, where the motor drives a first set of teeth which mesh with a second set (on the axle or by use of a gear box) for rotating the axle. In this invention, the drive of the motor is positioned at 90 degrees offset of the axle with the gearing designed to appropriately transfer energy from the first direction of the motor to the second direction of the axle. Such gearing is within the scope of the art in view of the present disclosure herein.

As used herein, the term "grinding stones" refers to one or more granite round stones on either side of the axle which rotate against the bottom of the vessel as in most wet grinders. In the case of the larger grinders of the present invention, the wheels can be larger but proportional to the size of the vessel, and each side can have multiple stone wheels, so that if a single stone wheel is damaged a larger stone wheel is not necessary, thus saving money, time, and the like, in the long run of use. In one embodiment, the stones are made of North Carolina pink granite. In one embodiment, the stones are used in a vessel of about 200 liters, and are 14 inches in height and 6 inches in width, though one of skill in the art in view of these disclosures can pick appropriately sized granite grinding wheels.

As used herein, the term "scraper" refers to a blade held against the inside wall of the vessel, which scrapes food off of the side of the vessel and deposits it back in the vessel. In general, use of such blades is common, however, the blade of the present invention is different. It is attached to the center axle by an arm, as shown in the drawings. The arm can then move up and down on the axle and, thus, is height adjustable. In addition, the length of the scraper can be changed by length adjusters, such as a screw mechanism or the like. In addition, the blade is removable from the arm and can be attached to the arm in multiple positions, giving the scraper adjustment in distance to the inside of the vessel. In one embodiment, there are multiple holes for mounting screws to provide multiple attachment distances for the scrapers from the inside of the vessel.

As used herein, the term "tilt frame" refers to a rectangular or semi-rectangular metal frame to which the vessel is attached to. The tilting mechanism is then attached to the tilting frame and, thus, when the frame is tilted the vessel comes along with it. The tilting frame is centered around the vessel, as shown in the figures, to give balance and improved tilting properties over previous tilting systems. The top of the tilt frame is attached to the top of the center axle and, at the bottom, to the bottom axle, with the gear box (or the like) at the bottom of the vessel mounted through the tilt frame. Optionally, the tilt frame could be attached to the vessel at other positions. Since there is a gearbox or gears at the bottom of the vessel, the rectangular frame can be broken here, and the gearbox or gears form the remaining part of the frame, or as described above, can be mounted below the frame. The tilt frame will have an opposing pair of balance arms, which are connected to the base frame with a gear drive for performing the tilting of the vessel. Since the present invention tends to be much heavier than previous vessels, utilizing gearing to tilt the vessel allows a smooth tilt and balance of the vessel.

As used herein, the term "base frame" refers to a metal frame for holding the tilt frame off the ground, for providing room for tilting, and, in one embodiment, providing room for transfer vessels for transfer of the contents of the tilted vessel to another vessel. As shown in the drawings, one version of the base frame is left and right triangular frames forming the sides, each with one apex pointing up. The two sides are then connected by floor beams, as shown in FIGS.

1 and 3, which, as also seen in the figures, are designed to leave room for a receptacle, as noted above. The balance arms are mounted toward the top of each side of the frame (while other designs could be contemplated) so that the balance arms rest on the frame and hold the vessel upright when the tilt frame is perpendicular to the ground.

As used herein, the term "gear drive for tilting the vessel" refers to a set of gear teeth on at least one side of the tilting frame.

The gear teeth are positioned so that when an attached crank arm (arm with matching teeth) or motor (with matching teeth) turns, it allows the gear to tilt the vessel in either direction. The torque of this type of system is enough to tilt heavier vessels of the present invention.

DRAWINGS

Now referring to the drawings, FIG. 1 is a perspective view of the upright wet grinder of the invention 1. The invention consists in this view of an upright vessel 2 (in this embodiment it is about 200 liters, has rolled edges, and is made of stainless steel). The vessel 2 is positioned in the upright position for use. Rectangular tilt frame 3 surrounds the vessel 2 and is centered using the center axle 4 attachment at both top and bottom (bottom view shown in FIG. 2) with tilt arm 5 sticking out and passing from tilt frame 3 to the left and right side of the grinder 1.

In this view, there are on/off and emergency switches 6 for use with the machine 1 and speed control 7 for adjusting the speed of the rotating vessel 2. These controls turn on the electric geared motor 8 which is connected to gear box 9 which in turn drives center axle 4 by a series of teeth (not seen, but within the skill in the art in view of this disclosure). Gear drive 11 can be operated with a hand crank or motor (removable or attached) connected to the gear teeth of the gear drive 11 to tilt the tilt frame 3 and the vessel 2. Taking advantage of the gear teeth allows for more torque to be applied for tilting a large vessel. The base 13 is shown with triangular sides 13*a* and base 13*b*. The base frame 13*c* is designed with open space 15 to allow a collection vessel to be positioned for pouring the contents of the vessel 2 out of the vessel into something.

Figure 2:
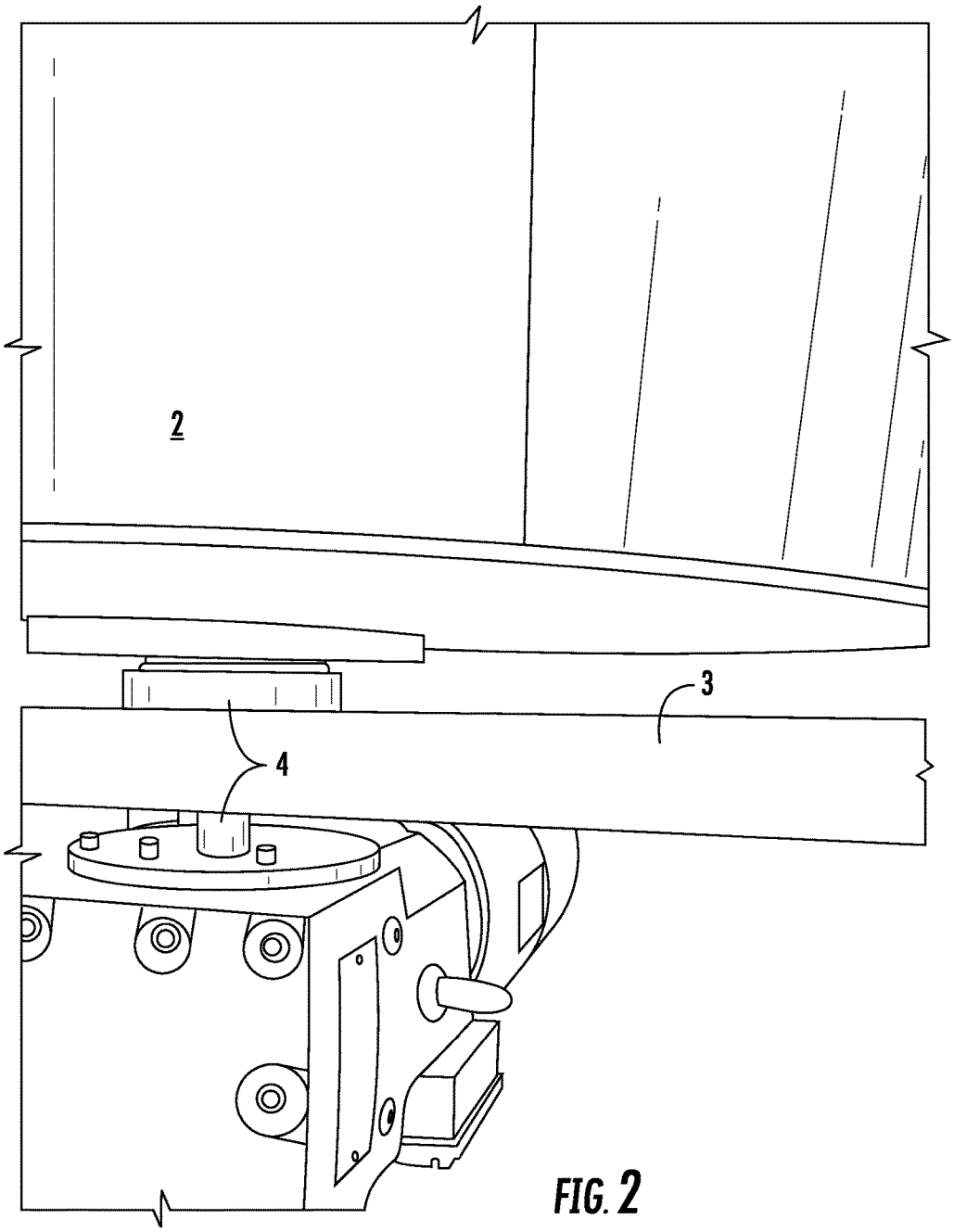
FIG. 2 is a bottom view of the current invention.

FIG. 2 is a close up perspective of the bottom of vessel 2. It shows one embodiment of the tilt frame 3 bottom positioned and attached to the vessel and the vertical axle 4. The axle 4 passes down from through the tilt frame 3 through vessel 2 bottom and into gear box 9 driven by gear motor 8.

Figure 3:
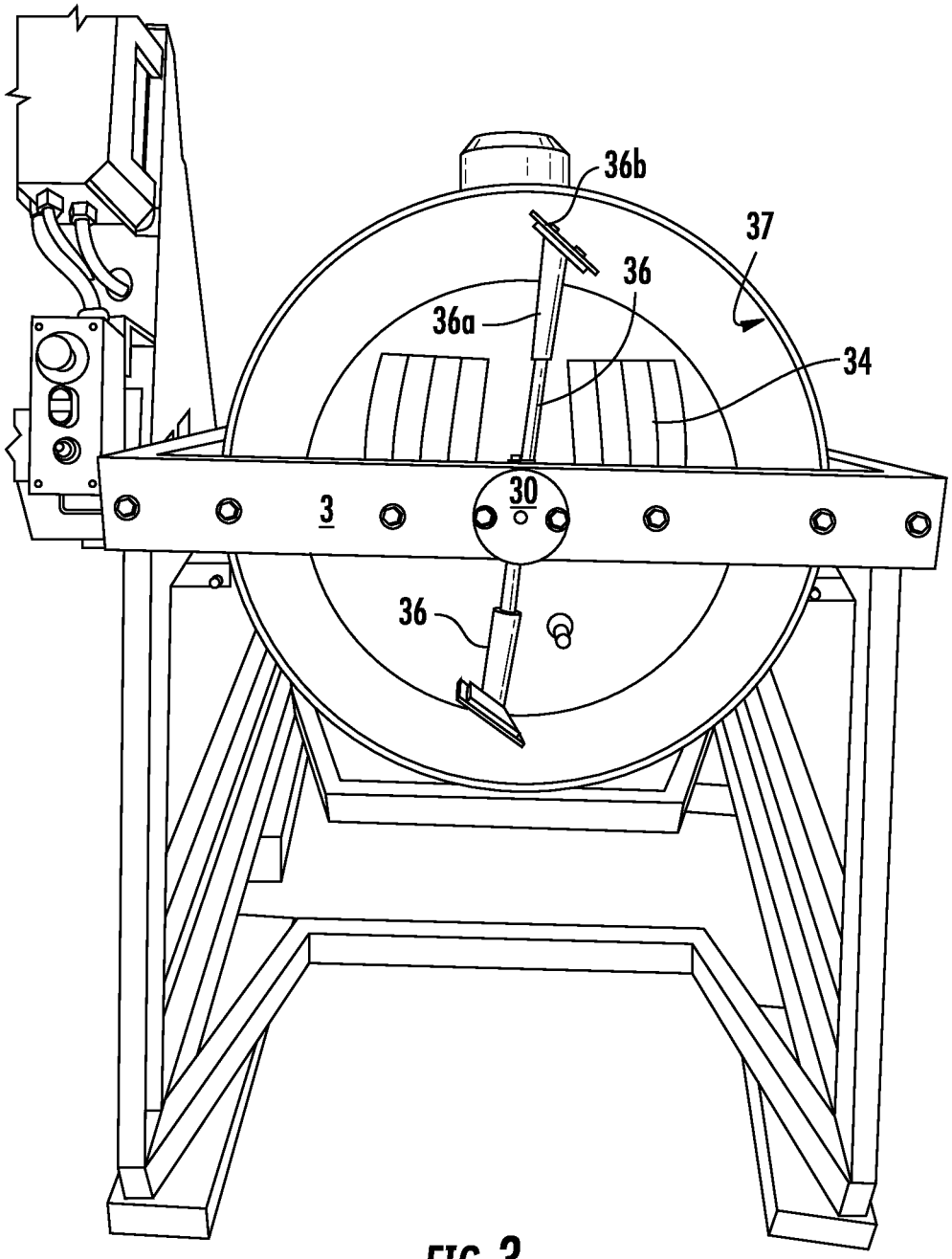
FIG. 3 is a frontal perspective view of the present invention with the vessel tilted 90 degrees for emptying.
Figure 4:
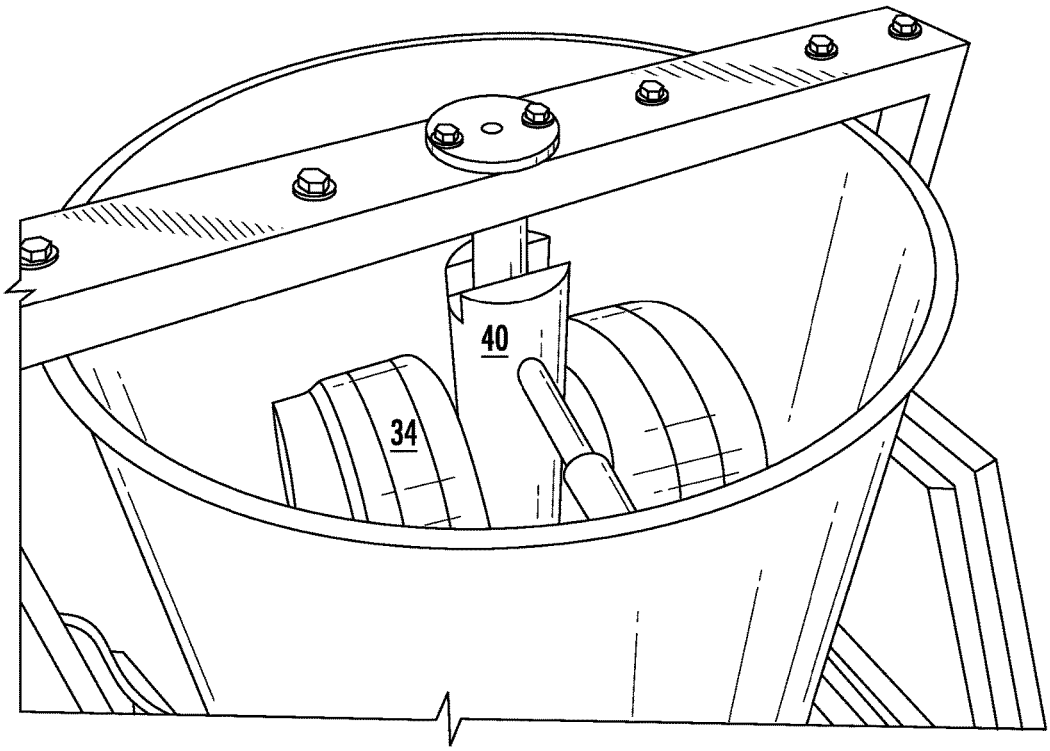
FIG. 4 is a view of the vessel of the current invention upright with the height adjustable device surrounding the center axle.

FIG. 3 is a frontal perspective of the wet grinder with the vessel 2 tilted 90 degrees for emptying. The center axle attachment 30 to the tilt frame 3 can be seen clearly in this view. Looking inside the vessel 2 one can see granite grinding stones 34 positioned on opposite sides of the center axle for grinding against the inside bottom 35 of the vessel 2. The pair of scraper arms 36 are shown with adjustable length arms 36*a*, and with adjustable scrapers 36*b*, for scraping the inner sidewall 37 of the vessel 2. A top perspective view in FIG. 4 shows the vessel upright with the scraper height adjustable device 40 surrounding the center axle for height adjustment of the scraper arms height in the vessel 2.

Figure 5:
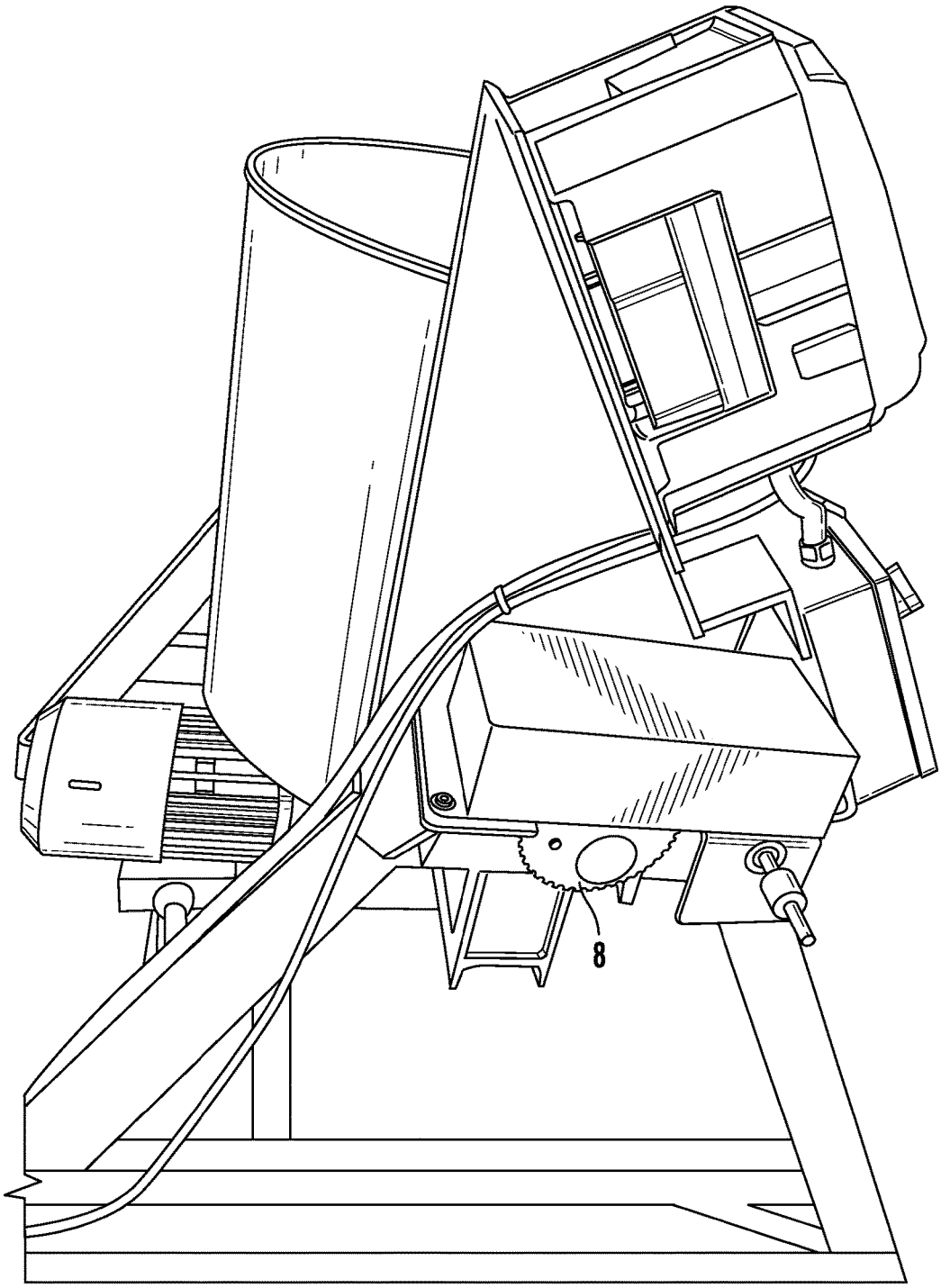
FIG. 5 is a side view perspective of the current invention.

FIG. 5 is a side view perspective of the upright wet grinder for the purpose of more clearly showing the gear drive 8 for tilting the tilt frame.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A food preparation upright wet grinder comprising:

a) a cylindrical vessel having an inside bottom and outside wall, and a volume of about 125 liters to 300 liters;

b) a center axle attached to and positioned vertically in the center of the vessel;

c) an adjustable speed gear driven motor positioned beneath the vessel connected to rotate the center axle;

d) granite grinding stones positioned on opposite sides of the center axle for grinding against the vessel's inside bottom, wherein the stones are rotated against the inside bottom of the vessel by the rotating action of the vessel;

e) one or more scrapers for scraping an inside wall of the vessel, the one or more scrapers having adjustable height and length arms, the scrapers being adjustable relative to the inside wall;

f) a tilt frame connected to the top of the center axle and the gear drive motor, comprising a pair of balance arms on opposite sides of the frame;

g) a base frame connected to the tilt frame by the balance arms; and h) a gear drive for tilting the vessel on the balance arms to and from an upright position.

2. The food preparation upright wet grinder according to claim 1 wherein the inside bottom of the cylindrical vessel is granite.

3. AR The food preparation upright wet grinder according to claim 1 wherein the inside bottom of the vessel is metal and designed to accept a granite bottom.

4. The food preparation upright wet grinder according to claim 1 wherein the vessel is made of stainless steel.

5. The food preparation upright wet grinder according to claim 1 wherein the speed the cylindrical vessel is rotated is between about 1 and 36 rpms.

6. The food preparation upright wet grinder according to claim 1 wherein the base frame has triangular shaped sides, wherein the balance arms connect to the sides at an apex of each triangular shape.

7. The food preparation upright wet grinder according to claim 1 wherein a motor is attached to the gear drive for tilting the vessel.

8. The food preparation upright wet grinder according to claim 1 wherein the tilt frame comprises a horizontal piece positioned across a top of the vessel and an upright piece supporting each end.

* * * * *